US007934402B2

(12) United States Patent
Lee

(10) Patent No.: US 7,934,402 B2
(45) **Date of Patent: *May 3, 2011**

(54) CLOTHES WASHING MACHINE

(75) Inventor: Young Su Lee, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 755 days.

This patent is subject to a terminal disclaimer.

(21) Appl. No.: 10/582,160

(22) PCT Filed: Apr. 8, 2004

(86) PCT No.: PCT/KR2004/000816

§ 371 (c)(1), (2), (4) Date: Apr. 16, 2007

(87) PCT Pub. No.: WO2005/056906

PCT Pub. Date: Jun. 23, 2005

(65) Prior Publication Data

US 2008/0041117 A1 Feb. 21, 2008

(30) Foreign Application Priority Data

Dec. 9, 2003 (KR) ..... 10-2003-0089133

(51) Int. Cl.
*D06F 39/08* (2006.01)

(52) U.S. Cl. ..... 68/17 R

(58) Field of Classification Search ..... 68/17 R
See application file for complete search history.

(56) References Cited

U.S. PATENT DOCUMENTS 4,755,268 A * 7/1988 Matsuo et al. ..... 205/746
5,579,656 A 12/1996 Shin
5,675,994 A 10/1997 Gweon
(Continued)

FOREIGN PATENT DOCUMENTS

JP 3-215296 9/1991
(Continued)

OTHER PUBLICATIONS

Translation of KR 2002-012368 A, date not applicable.*
(Continued)

*Primary Examiner* — Joseph L Perrin
(74) *Attorney, Agent, or Firm* — Staas & Halsey LLP

(57) ABSTRACT

A washing machine includes a colloidal silver maker and a detergent feeder which are integrated with each other, thus enhancing assembility and reliability of the washing machine. The colloidal silver maker includes a silver ion casing, a lid, and a pair of silver plates. An outlet pipe and a connecting part are provided on predetermined portions of the silver ion casing. The outlet pipe is integrated with an inlet of the detergent feeder, and the connecting part integrally connects the colloidal silver maker to the detergent feeder. Thus, the colloidal silver maker is integrated with the detergent feeder while the silver ion casing of the colloidal silver maker communicating with the detergent feeder. The silver plates are placed in the silver ion casing while being supported by the lid. Further, at least one spacing projection is upwardly projected from a bottom of the silver ion casing to be provided between the silver plates.

11 Claims, 4 Drawing Sheets

U.S. PATENT DOCUMENTS

| | | | | |
|---|---|---|---|---|
| 6,743,351 | B1 * | 6/2004 | Arai et al. | 205/701 |
| 6,766,817 | B2 | 7/2004 | da Silva | |
| 6,918,404 | B2 | 7/2005 | Dias da Silva | |
| 7,066,586 | B2 | 6/2006 | Da Silva | |
| 2004/0025263 | A1 * | 2/2004 | Kim et al. | 8/159 |
| 2004/0172985 | A1 * | 9/2004 | Mamiya et al. | 68/12.05 |
| 2004/0205899 | A1 * | 10/2004 | Park et al. | 8/159 |

FOREIGN PATENT DOCUMENTS

| | | | |
|---|---|---|---|
| JP | 5-84384 | | 4/1993 |
| JP | 2001-276484 | | 10/2001 |
| JP | 2003-991 | | 1/2003 |
| JP | 2003-290594 | | 10/2003 |
| KR | 2002-12368 | | 2/2002 |
| KR | 20-0299230 | | 12/2002 |
| KR | 2003-0042505 | | 6/2003 |
| WO | WO02081808 | * | 10/2002 |
| WO | WO03057970 | | 7/2003 |

OTHER PUBLICATIONS

U.S. Appl. No. 10/582,130, filed Jun. 8, 2006, Samsung Electronics Co., Ltd., Young Su Lee.

U.S. Appl. No. 10/582,136, filed Jun. 8, 2006, Samsung Electronics Co., Ltd., Young Su Lee.

Restriction Requirement dated Nov. 19, 2009 for related U.S. Appl. No. 10/582,130.

Office Action dated Jan. 4, 2010 for related U.S. Appl. No. 10/582,136.

Chinese Office Action for Chinese Patent Application No. 2004-800364483 (correspond to U.S. Appl. No. 10/582,130) dated Sep. 19, 2008.

Chinese Office Action for Chinese Patent Application No. 2004-00363245 (correspond to U.S. Appl. No. 10/582,136) dated Sep. 19, 2008.

* cited by examiner

[Fig. 1]
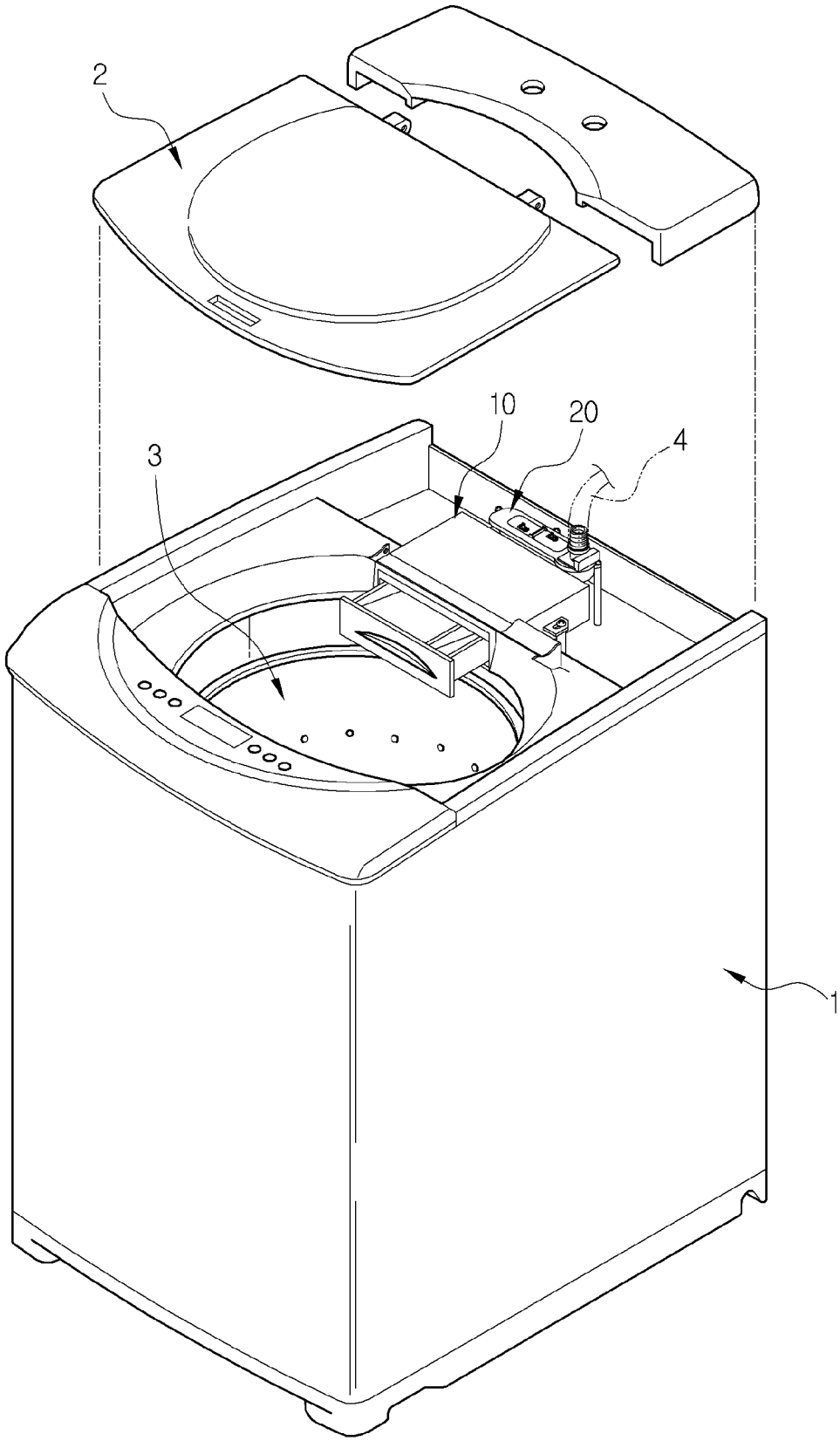

[Fig. 2]
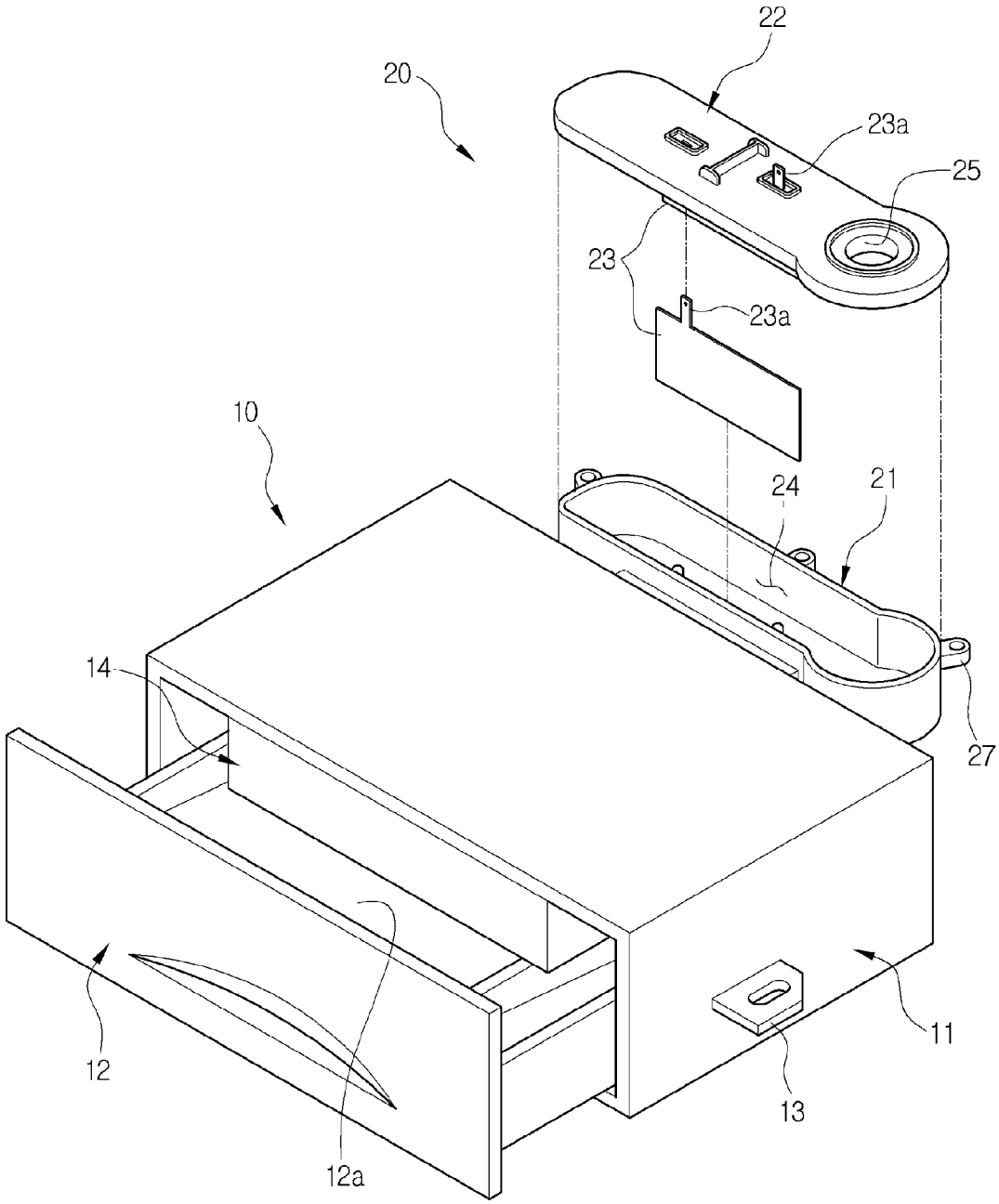

[ Fig. 3]
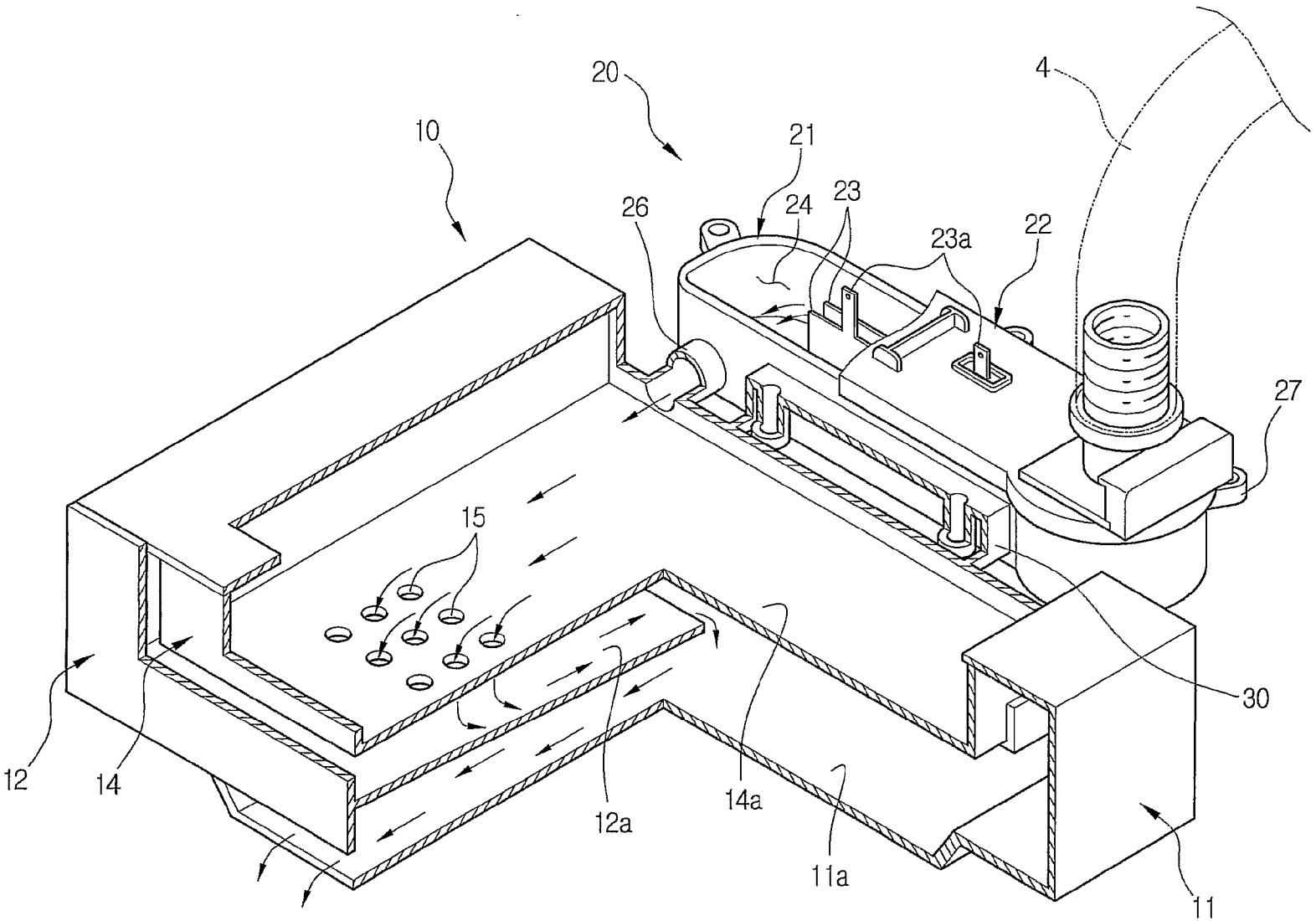

[Fig. 4]
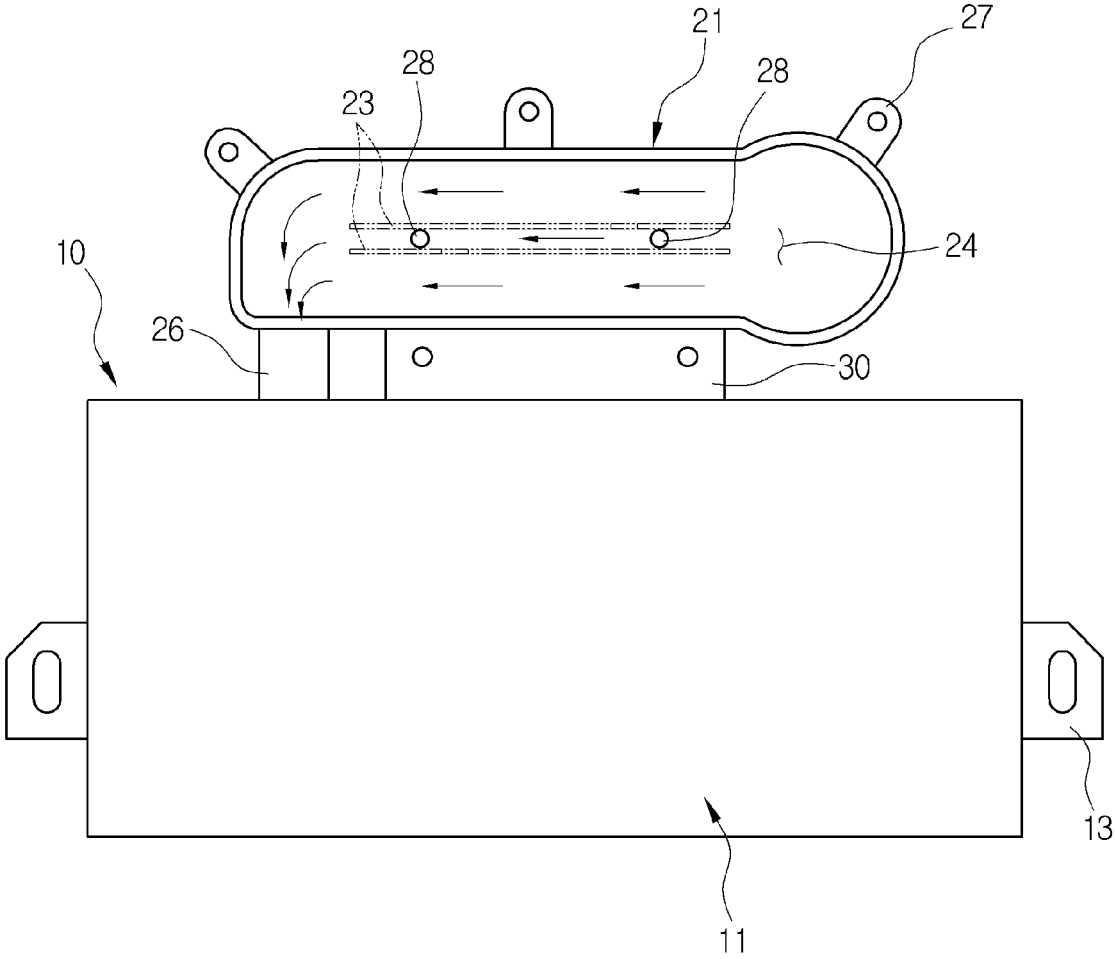

CLOTHES WASHING MACHINE

TECHNICAL FIELD

The present invention relates, in general, to washing machines and more particularly, to a washing machine which is constructed so that a colloidal silver maker is integrated with a detergent feeder into a single structure, thus enhancing assembility and having a superior washing performance.

BACKGROUND ART

Generally, washing machines are appliances to wash laundry placed in a washing tub, by agitating the laundry inside the washing tub in the presence of wash water and a detergent.

The washing machine includes a motor, a water tub, the washing tub, a pulsator, and a detergent feeder. The water tub contains wash water therein. The washing tub is rotatably set in the water tub, with the laundry to be washed being placed in the washing tub. The pulsator is rotatably projected from a bottom of the washing tub, and agitates the laundry in the wash water. The detergent feeder is provided at a predetermined position above the water tub, and feeds detergent into the wash water fed from an external water source.

The washing machine is operated as follows. First, the laundry is loaded into the washing tub. The wash water, mixed with the detergent fed from the detergent feeder, is supplied to the water tub. When the motor operates in such a state, the pulsator rotates in alternating directions to agitate the laundry in the wash water, thus washing the laundry.

Recently, there has been developed a washing machine having a colloidal silver maker to add silver ions into wash water while the wash water is fed into the water tub, thus producing colloidal silver which kills germs on the laundry while washing the laundry. Therefore, the washing machine with the colloidal silver maker has both antibacterial and bactericidal effects.

The colloidal silver maker includes a pair of silver plates to which a predetermined voltage is applied. When the wash water passes through the silver plates, the silver plates dissociate the silver ions into the wash water by electrolysis of the silver plates, so that colloidal silver is produced and fed into the water tub.

The washing machine with the colloidal silver maker allows the laundry to be washed by the wash water in which the silver ions of a predetermined concentration are dissolved thus killing germs on the laundry.

However, the conventional washing machine with the colloidal silver maker has a problem in that the colloidal silver maker and the detergent feeder are separately manufactured and then separately installed in the washing machine, so that assembling work to mount the colloidal silver maker to the washing machine is required, in addition to assembling work to mount the detergent feeder to the washing machine, and thus increases in an assembling period and assembling costs of the washing machine are incurred.

In the conventional washing machine with the colloidal silver maker, the wash water passes through the colloidal silver maker and the detergent feeder so that the silver ions and the detergent are added to the wash water, prior to being fed into the water tub. Thus, the colloidal silver maker must be connected to the detergent feeder.

Therefore, the conventional washing machine with the colloidal silver maker has another problems in that an increase in assembling period is incurred to connect the colloidal silver maker to the detergent feeder, and the wash water may leak through a junction between the colloidal silver maker and the detergent feeder due to a water pressure or repeated use, thus deteriorating reliability of the washing machine.

DISCLOSURE OF INVENTION

Technical Problem

It is an aspect of the present invention to provide a washing machine which is constructed so that a colloidal silver maker is integrated with a detergent feeder into a single structure, thus enhancing assembility and reliability of the washing machine.

Additional aspects and/or advantages of the invention will be set forth in part in the description which follows and, in part, will be obvious from the description, or may be learned by practice of the invention.

Technical Solution

The above and/or other aspects are achieved by a washing machine, including a colloidal silver maker to produce colloidal silver, a detergent feeder to feed a detergent, and an outlet pipe to feed the colloidal silver from the colloidal silver maker to the detergent feeder, the outlet pipe integrally connecting the colloidal silver maker to the detergent feeder into a single structure.

According to an aspect of the invention, the washing machine may further include a connecting part. The connecting part may be provided between the colloidal silver maker and the detergent feeder to integrally connect the colloidal silver maker to the detergent feeder, and may integrate the colloidal silver maker with the detergent feeder into the single structure, in cooperation with the outlet pipe.

In another aspect of this embodiment, the colloidal silver maker may include a silver ion casing to define a water passage through which water passes, and a pair of silver plates placed in the water passage of the silver ion casing to generate silver ions.

In yet another aspect of this embodiment, the colloidal silver maker may further include a lid mounted to an upper portion of the silver ion casing, with an inlet hole being provided on a predetermined portion of the lid to feed the water into the silver ion casing. The plurality of silver plates may be placed in the silver ion casing while being supported by the lid.

In still another aspect of this embodiment, at least one spacing projection may be provided between the pair of silver plates, and be upwardly projected from a bottom of the silver ion casing.

In yet another aspect of this embodiment, the inlet hole may be provided on an end of the lid to correspond to a first end of the silver ion casing, and the outlet pipe may be provided on a second end of the silver ion casing, so that the silver ions dissociated from the pair of silver plates are added to the water while the water introduced into the silver ion casing through the inlet hole flows from the first end to the second end of the silver ion casing.

The above and/or other aspects are achieved by a washing machine, including a colloidal silver maker to produce colloidal silver, a detergent feeder to feed a detergent, a water tub provided under the detergent feeder, and a connection pipe to integrally connect a lower end of a predetermined portion of the colloidal silver maker to an upper end of a corresponding portion of the detergent feeder so that the colloidal silver maker and the detergent feeder are integrated with each other, the colloidal silver being fed from the colloidal silver maker through the connection pipe to an upper portion of the detergent feeder.

The detergent feeder may include a body to define an external appearance of the detergent feeder, with the connection pipe being connected to a predetermined portion of the body, a spray unit provided in the body to be disposed under the connection pipe and having a plurality of spray holes to spray the colloidal silver fed through the connection pipe onto a lower portion of the body, and a detergent container to slide through a front of the body, with the detergent being mixed with the colloidal silver sprayed through the spray holes in the detergent container.

The detergent container may be placed in the body of the detergent feeder while a bottom surface of the detergent container being spaced apart from a bottom surface and a rear surface of the body, so that the colloidal silver sprayed through the spray holes flows to a rear portion of the detergent container together with the detergent contained in the detergent container, and then flows to a front portion of the body along the bottom surface of the body, prior to falling into the water tub.

ADVANTAGEOUS EFFECTS

As is apparent from the above description, the present invention provides a washing machine, which is constructed so that a colloidal silver maker is integrated with a detergent feeder, thus it is unnecessary to further assemble the colloidal silver maker to a cabinet of the washing machine and thereby reducing assembling costs and assembling periods of the washing machine.

Further, in the washing machine according to the present invention, an outlet pipe of the colloidal silver maker, which introduces wash water into the detergent feeder, is integrally connected to the detergent feeder, so that it is unnecessary to further connect the outlet pipe to the detergent feeder, thus preventing the wash water from leaking through the outlet pipe due to a water pressure of the wash water or repeated use of the washing machine.

Although an embodiment of the present invention has been shown and described, it would be appreciated by those skilled in the art that changes may be made in these embodiments without departing from the principles and spirit of the invention, the scope of which is defined in the claims and their equivalents.

DESCRIPTION OF DRAWINGS

These and other aspects and advantages of the invention will become apparent and more readily appreciated from the following description of the preferred embodiments, taken in conjunction with the accompanying drawings of which:

FIG. 1 is a perspective view of a washing machine having a colloidal silver maker and a detergent feeder, according to an embodiment of the present invention;

FIG. 2 is a perspective view of the colloidal silver maker connected to the detergent feeder of the washing machine of FIG. 1;

FIG. 3 is a partially cutaway perspective view to show a junction between the colloidal silver maker and the detergent feeder, and the detergent feeder of FIG. 2; and FIG. 4 is a view to show a flow of wash water from the colloidal silver maker to the detergent feeder of FIG. 3, in which the wash water passes through the colloidal silver maker to produce colloidal silver.

BEST MODE

Reference will now be made in detail to the present preferred embodiments of the present invention, examples of which are illustrated in the accompanying drawings, wherein like reference numerals refer to like elements throughout. The embodiment is described below in order to explain the present invention by referring to the figures.

FIG. 1 is a perspective view of a washing machine having a colloidal silver maker and a detergent feeder, according to an embodiment of the present invention. As shown in FIG. 1, the washing machine includes a cabinet 1 to define an external appearance of the washing machine. A door 2 opens or closes an upper portion of the cabinet 1. A washing tub 3 and a water tub (not shown) are set in the cabinet 1. A pulsator (not shown) is rotatably projected from a bottom of the washing tub 3. A motor (not shown) is provided at a predetermined position under the water tub to rotate the washing tub 3 and the pulsator.

Further, the detergent feeder 10 and the colloidal silver maker 20 are provided at predetermined positions above the water tub or the washing tub 3 so that detergent and silver ions are added to wash water fed from an external water source, prior to being fed to the water tub. In a detailed description, the wash water is fed to the colloidal silver maker 20 through a water supply hose 4 which is connected to the external water source, and the silver ions of a predetermined concentration are added to the wash water. Thereafter, the wash water containing the silver ions passes through the detergent feeder 10. Thus, the wash water is fed to the water tub while being mixed with the detergent.

As such, when the detergent and the silver ions are added to the wash water, the laundry is washed by a cleansing effect of the detergent, and simultaneously germs on the laundry are killed by antibacterial and bactericidal actions of the silver ions.

The bactericidal action of silver will be described hereinafter in brief. The silver has no tolerance for germs, different from other common antibiotics. Further, silver is a very safe substance, because silver is nontoxic. Thus, when the laundry is washed using the silver, the laundry has better hygiene due to the antibacterial and bactericidal effects of the silver. Therefore, when a predetermined amount of silver ions are dissolved in the wash water by electrolysis and the wash water containing the silver ions is fed to the water tub, the germs on the laundry are killed while the laundry is washed using the wash water containing the silver ions.

FIG. 2 is a perspective view of the colloidal silver maker of FIG. 1. As shown in FIG. 2, the colloidal silver maker 20 includes a silver ion casing 21, a lid 22, and a pair of silver plates 23. The silver ion casing 21 defines a water passage 24 through which the wash water passes, and provides a space for the electrolysis of the silver plates 23. The lid 22 covers an upper portion of the silver ion casing 21. The silver plates 23 are placed between the silver ion casing 21 and the lid 22, and provide the silver ions to the wash water.

A terminal 23*a* is integrally provided on an upper end of each of the silver plates 23 so that each of the silver plates 23 is electrically connected to an electric source via wires (not shown). Each of the silver plates 23 is supported by the lid 22 while the terminal 23*a* thereof is projected from the lid 22 by a predetermined length.

An inlet hole 25 is provided on an end of the lid 22 so that the water supply hose 4 (see, FIG. 3) connected to the external water source is inserted into the inlet hole 25. On an end of the silver ion casing 21 which is far away from the inlet hole 25, is provided an outlet pipe 26 (see, FIG. 3) so that the wash water containing the silver ions is fed from the silver ion casing 21 to the detergent feeder 10 through the outlet pipe 26.

The detergent feeder 10 includes a body 11, a detergent container 12, and a water spray unit 14. The body 11 is opened at a front thereof. The detergent container 12 slides through the open front of the body 11, and is detachably installed in the body 11, and contains the detergent therein. The water spray unit 14 is provided in the body 11 of the detergent feeder 10 to be placed above a bottom surface 12*a* of the detergent container 12.

Thus, the wash water fed into the body 11 through the outlet pipe 26 of the colloidal silver maker 20 is sprayed from the water spray unit 14 onto the detergent container 12 so that the wash water is mixed with the detergent. Thereafter, the wash water containing the silver ions and the detergent falls into the water tub through a gap defined between the bottom surface 12*a* of the detergent container 12 and the body 11, thus soaking the laundry. The flow of the wash water from the detergent feeder 10 to the water tub will be described later herein with reference to FIG. 4.

In the detergent feeder 10 and the colloidal silver maker 20 constructed as described above, the detergent feeder 10 is mounted to the upper portion of the cabinet 1 through hook holes which are formed on brackets 13 provided on both sidewalls of the body 11, and the colloidal silver maker 20 is mounted to the upper portion of the cabinet 1 through screw holes which are formed on brackets 27 provided on an outer surface of the colloidal silver maker 20.

FIG. 3 is a partially cutaway perspective view to show a junction between the colloidal silver maker and the detergent feeder, and the detergent feeder of FIG. 2. As shown in FIG. 3, the colloidal silver maker 20 according to the present invention is integrally connected to the detergent feeder 10.

The outlet pipe 26 of the colloidal silver maker 20 has a circular cross-section, and is integrally connected to the detergent feeder 10. Thus, the outlet pipe 26 serves as a connection pipe to integrally connect the colloidal silver maker 20 to the detergent feeder 10. Further, the outlet pipe 26 functions as an inlet pipe to feed the wash water containing the silver ions into the detergent feeder 10.

As described above, the outlet pipe 26 is integrally provided between the colloidal silver maker 20 and the detergent feeder 10 to connect the colloidal silver maker 20 to the detergent feeder 10. Thus, work to connect an outlet of the colloidal silver maker 20 to an inlet of the detergent feeder 10 is not required. Further, there is no leakage through the junction between the colloidal silver maker 20 and the detergent feeder 10 due to a water pressure or repeated use of the washing machine.

Further, between the colloidal silver maker 20 and the detergent feeder 10 is provided a connecting part 30. The connecting part 30 integrally connects the colloidal silver maker 20 to the detergent feeder 10, in cooperation with the outlet pipe 26. The connecting part 30, having a predetermined length and a rectangular cross-section which has no bottom side, is provided on a central portion of the junction between the colloidal silver maker 20 and the detergent feeder 10 to integrate the colloidal silver maker 20 to the detergent feeder 10 into a single structure.

After the silver ion casing 21 of the colloidal silver maker 20 is integrated with the body 11 of the detergent feeder 10 by the outlet pipe 26 and the connecting part 30, the lid 22 supporting the pair of silver plates 23 is mounted to the open upper portion of the silver ion casing 21. Thus, the colloidal silver maker 20 is integrated with the detergent feeder 10 into the single structure.

As such, because the silver ion casing 21 of the colloidal silver maker 20 is integrated with the detergent feeder 10, it is unnecessary to further assemble the colloidal silver maker 20 to the cabinet 1 of the washing machine, thus reducing assembling costs and assembling periods of the washing machine.

As described above, the detergent feeder 10 includes the body 11 to define an external appearance thereof, the spray unit 14 installed in a predetermined portion of the body 11, and the detergent container 12 which is slidably pulled out and pushed into the body 11.

A bottom surface 14*a* of the spray unit 14 is provided under the outlet pipe 26, with a plurality of spray holes 15 being provided on a front portion of the bottom surface 14*a*. Thus, the wash water fed into the spray unit 14 through the outlet pipe 26 is sprayed onto the detergent container 12 through the spray holes 15.

The bottom surface 12*a* of the detergent container 12 is rearwardly and downwardly inclined. Further, the detergent container 12 is placed so that the bottom surface 12*a* thereof is spaced apart from a bottom surface 11*a* and a rear surface of the body 11 by predetermined intervals, when the detergent container 12 is pushed into the body 11.

Thus, the wash water sprayed onto the bottom surface 12*a* of the detergent container 12 through the spray holes 15 flows to a rear portion of the bottom surface 12*a* together with the detergent disposed on the bottom surface 12 of the detergent container 12, and falls to the bottom surface 11*a* of the body 11. Subsequently, the wash water flows to a front portion of the bottom surface 11*a* of the body 11, prior to falling into the water tub or the washing tub 3 (see, FIG. 1).

FIG. 4 is a view to show the flow of the wash water from the colloidal silver maker to the detergent feeder of FIG. 2, in which the silver ions are added to the wash water when the wash water passes through the colloidal silver maker. As shown in FIG. 4, the body 11 of the detergent feeder 10 is integrally connected to the silver ion casing 21 of the colloidal silver maker 20 by the outlet pipe 26 and the connecting part 30. The pair of silver plates 23 are placed in the silver ion casing 21 while being supported by the lid 22 mounted to the upper portion of the silver ion casing 21, and are arranged in parallel to a flowing direction of the wash water.

Spacing projections 28 are projected from a bottom of the silver ion casing 21. The spacing projections 28 are provided between the pair of silver plates 23 to allow the silver plates 23 to be spaced apart from each other by a predetermined interval.

Thus, the pair of silver plates 23 are electrically connected to the electric source through the terminals 23*a* of the silver plates 23. Thus, when a predetermined voltage is applied to the silver plates 23 and the wash water is fed into the colloidal silver maker 20 through the inlet hole 25 (see, FIG. 2) of the lid 22, the wash water passes through the silver plates 23 while flowing along the water passage 24 of the silver ion casing 21. At this time, the silver ions are dissociated from the silver plates 23 by the electrolysis of the silver plates 23. Thus, the silver ions of the predetermined concentration are added to the wash water.

The wash water containing the silver ions is fed to the detergent feeder 10 through the outlet pipe 26. Thus, the wash water falls to the washing tub 3 while being mixed with the detergent.

As such, while the wash water passing through the colloidal silver maker 20 and the detergent feeder 10, the silver ions and the detergent are added to the wash water, thus enhancing a washing performance and providing a bactericidal effect.

The invention claimed is:

1. A washing machine, comprising:

a water tub;

a washing tub rotatably disposed in the water tub;

a water supply unit to supply water from an external water source to the washing tub;

a colloidal silver maker coupled to the water supply unit to directly receive water from the ater supply unit;

a detergent feeder connected to the colloidal silver maker to receive the colloidal silver-containing wash water from the colloidal silver maker and feed the colloidal silver-containing wash water to the washing tub, the detergent feeder having a body opened at a front thereof and a detergent container sliding through the open front of the body; and an outlet pipe provided at a side of the colloidal silver maker to feed the colloidal silver-containing wash water from the colloidal silver maker to the detergent feeder, the outlet pipe being disposed between the colloidal silver maker and the detergent feeder and integrally formed with the colloidal silver maker and the detergent feeder so that the colloidal silver-containing wash water produced from the colloidal silver maker is supplied to the washing tub through the detergent feeder, wherein the colloidal silver maker comprises a silver ion casing to define a water passage through which wash water passes and a pair of silver plates placed in the water passage of the silver ion casing and submerged by wash water flowing along the water passage to generate silver ions, the pair of silver plates being arranged in parallel to a flowing direction of the wash water.

2. The washing machine according to claim 1, further comprising:

a connecting part provided between the colloidal silver maker and the detergent feeder to integrally connect the colloidal silver maker to the detergent feeder, the connecting part integrating the colloidal silver maker with the detergent feeder into the single structure, in cooperation with the outlet pipe.

3. The washing machine according to claim 1, wherein the colloidal silver maker further comprises:

a lid mounted to an upper portion of the silver ion casing with an inlet hole being provided on a predetermined portion of the lid to feed the water into the silver ion casing wherein the plurality of silver plates are placed in the silver ion casing while being supported by the lid.

4. The washing machine according to claim 3, further comprising:

at least one spacing projection provided between the pair of silver plates, the spacing projection being upwardly projected from a bottom of the silver ion casing.

5. The washing machine according to claim 3, wherein the inlet hole is provided on an end of the lid to correspond to a first end of the silver ion casing and the outlet pipe is provided on a second end of the silver ion casing so that the silver ions dissociated from the pair of silver plates are added to the water while the water introduced into the silver ion casing through the inlet hole flows from the first end to the second end of the silver ion casing.

6. The washing machine according to claim 1, wherein the detergent feeder receives water only through the colloidal silver maker.

7. The washing machine according to claim 1, wherein the colloidal silver maker and the detergent feeder are disposed at an upper portion of the washing machine.

8. A washing machine, comprising:

a colloidal silver maker to produce colloidal silver;

a detergent feeder to feed a detergent;

a water tub provided under the detergent feeder; and a connection pipe to integrally connect a lower end of a predetermined portion of the colloidal silver maker to an upper end of a corresponding portion of the detergent feeder so that the colloidal silver maker and the detergent feeder are integrated with each other, the colloidal silver being fed from the colloidal silver maker through the connection pipe to an upper portion of the detergent feeder, wherein the colloidal silver maker comprises a silver ion casing to define a water passage through which water passes, with a connection pipe being provided on a predetermined portion of the silver ion casing, a lid mounted to an upper portion of the silver ion casing with an inlet hole being provided on a predetermined portion of the lid to feed the water into the silver ion casing, and a pair of silver plates placed in the silver ion casing while being supported by the lid and submerged by wash water flowing along the water passage to generate silver ions.

9. The washing machine according to claim 8, wherein the detergent feeder comprises:

a body to define an external appearance of the detergent feeder, with the connection pipe being connected to a predetermined portion of the body;

a spray unit provided in the body to be disposed under the connection pipe, the spray unit having a plurality of spray holes to spray the colloidal silver fed through the connection pipe onto a lower portion of the body; and a detergent container to slide through a front of the body, with the detergent being mixed with the colloidal silver sprayed through the spray holes in the detergent container.

10. The washing machine according to claim 9, wherein the detergent container is placed in the body of the detergent feeder while a bottom surface of the detergent container being spaced apart from a bottom surface and a rear surface of the body, so that the colloidal silver sprayed through the spray holes flows to a rear portion of the detergent container together with the detergent container in the detergent container, and then flows to a front portion of the body along the bottom surface of the body, prior to falling into the water tub.

11. The washing machine according to claim 8, wherein the inlet hole is provided on an end of the lid to correspond to a first end of the silver ion casing and the connection pipe is provided on a second end of the silver ion casing so that the silver ions dissociated from the pair of silver plates are added to the water while the water introduced into the silver ion casing through the inlet hole flows from the first end to the second end of the silver ion casing.

* * * * *

UNITED STATES PATENT AND TRADEMARK OFFICE

CERTIFICATE OF CORRECTION

PATENT NO. : 7,934,402 B2
APPLICATION NO. : 10/582160
DATED : May 3, 2011
INVENTOR(S) : Young Su Lee It is certified that error appears in the above-identified patent and that said Letters Patent is hereby corrected as shown below:

Column 7, Line 8, In Claim 1, delete “ater” and insert -- water --, therefor.

Column 7, Line 54, In Claim 5, delete “casing” and insert -- casing, --, therefor.

Column 7, Line 55, In Claim 5, delete “casing” and insert -- casing, --, therefor.

Column 8, Line 48, In Claim 10, delete “container” and insert -- contained --, therefor.

Signed and Sealed this
Thirty-first Day of January, 2012

David J. Kappos

David J. Kappos
*Director of the United States Patent and Trademark Office*